United States Patent [19]

Pidgeon

[11] 4,148,489

[45] Apr. 10, 1979

[54] PUZZLE

[76] Inventor: Joseph F. Pidgeon, 31180 Walden Ct., Walled Lake, Mich. 48088

[21] Appl. No.: 808,129

[22] Filed: Jun. 20, 1977

[51] Int. Cl.[2] ..... A63F 9/12

[52] U.S. Cl. ..... 273/160

[58] Field of Search ..... 273/160

[56] References Cited

U.S. PATENT DOCUMENTS

| | | | |
|---|---|---|---|
| 1,225,760 | 5/1917 | Brown | 273/160 |
| 1,261,242 | 4/1918 | Keiser | 273/160 |
| 1,425,107 | 8/1922 | Levinson | 273/160 |
| 2,836,421 | 5/1958 | Turner | 273/160 |

*Primary Examiner*—Anton O. Oechsle

*Attorney, Agent, or Firm*—Gifford, Chandler, VanOphem, Sheridan & Sprinkle

[57] ABSTRACT

A three-dimensional geometric puzzle is provided and comprises six elongated members, each having a rectangular cross-sectional shape. The members are arranged in three pairs so that both members in each pair are in a side-by-side abutting relationship. In addition, each pair of members intersects the other two pairs perpendicularly and substantially at its midpoint thus forming a star-shaped configuration. The members can be assembled to and disassembled from the star-shape configuration in a predetermined order.

5 Claims, 6 Drawing Figures

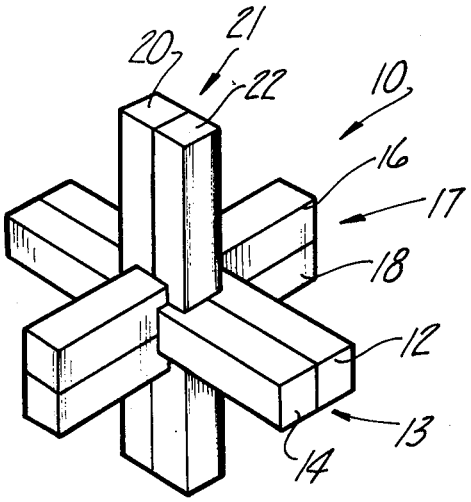
Fig-1
Fig-3
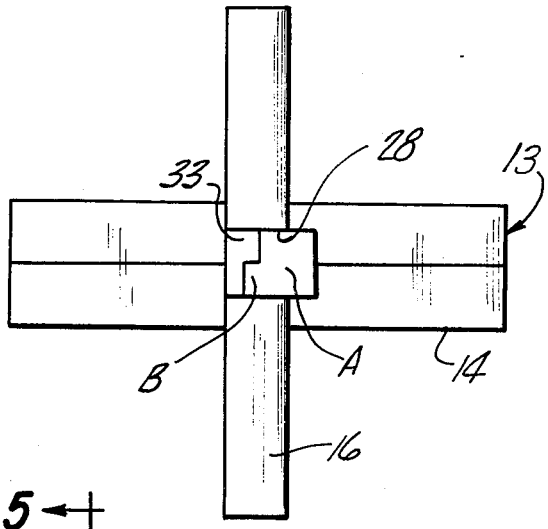
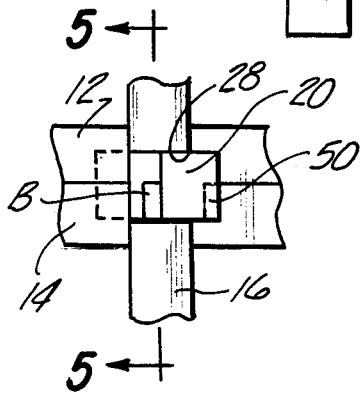
Fig-4
Fig-5
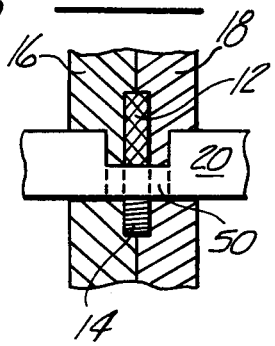
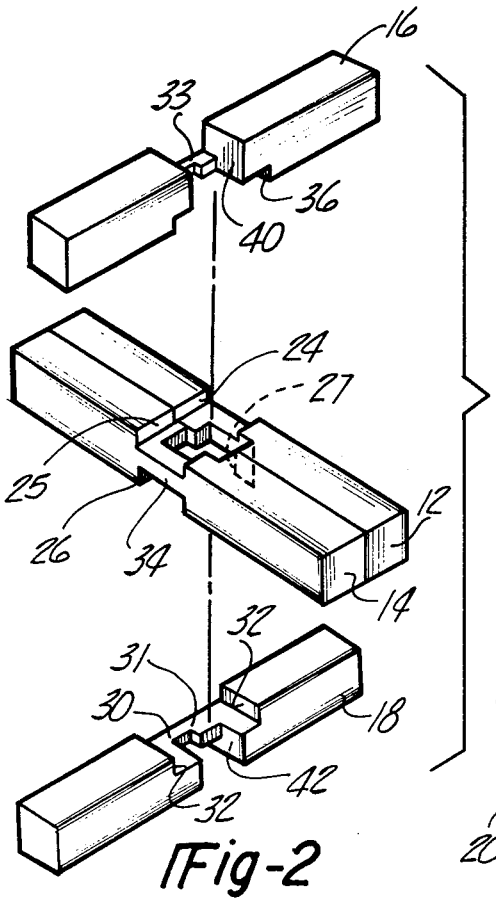
Fig-2
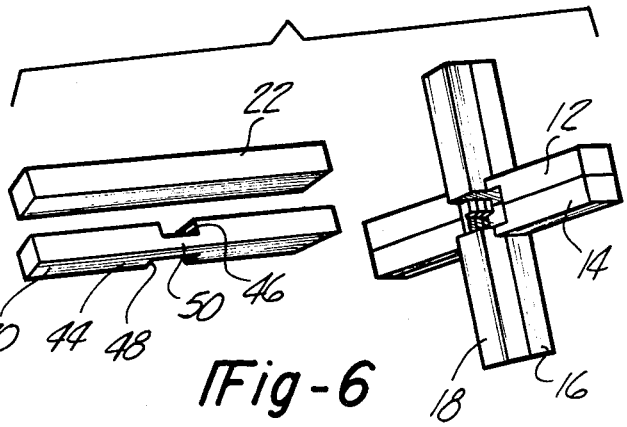
Fig-6

PUZZLE

BACKGROUND OF THE INVENTION

I. Field of the Invention

The present invention relates generally to puzzles and, more particularly, to a three-dimensional geometric puzzle.

II. Description of the Prior Art

Three-dimensional geometric puzzles have been long known and enjoyed by many as a challenge of one's wits. Such puzzles can typically be disassembled to a plurality of seemingly randomly shaped pieces which, when properly fitted together, interlock and form a predetermined geometric figure, typically a cube.

No previous geometric puzzle of this type has been known in which the geometric figure formed is a three-dimensional star-shaped configuration. There are several heretofore insurmountable difficulties encountered when attempting to construct a star-shaped puzzle of this type.

A prime difficulty in constructing a star-shaped three-dimensional puzzle is due to the limited intersection area of the members, i.e., all of the puzzle members must intersect each other substantially centrally. As a result, multiple members must occupy or extend through the same limited area of the puzzle and this difficulty has heretofore prevented such star-shaped puzzles.

A still further difficulty with star-shaped puzzles is the difficulty in interlocking the members together when assembled. Unlike the cube-shaped geometric puzzles which can be interlocked together when assembled at a plurality of spaced locations, with star-shaped geometric puzzles, the interlock between the members can occur only where the members abut, i.e., at their central point of intersection. This problem in conjunction with the aforementioned problem has heretofore precluded the construction of a star-shaped geometric puzzle.

SUMMARY OF THE PRESENT INVENTION

The present invention overcomes the above-mentioned disadvantages of the previously-known three-dimensional puzzles by providing a three-dimensional star-shaped puzzle in which the members interfit and interlock together substantially centrally on each member.

In brief, the puzzle according to the present invention comprises six elongated members having a rectangular and preferably square cross-sectional shape. The first and second member each include a channel portion so that with the first and second members positioned in a side-by-side abutting engagement, the channel portions face each other and form or define an axial throughbore. The axial throughbore has a cross-sectional shape corresponding to the cross-sectional shape "A" of any of the elongated members and in addition includes an additional cross-sectional area "B" protruding from one corner of the first cross-sectional area "A".

A third member is positioned perpendicularly across the first two members in a lateral channel formed on one side of the first two members while a fourth member is positioned perpendicularly across the first two members in a lateral channel formed on the other side of the first two members. The third and fourth members abut against each other in a side-by-side relationship so that the first two members are sandwiched and entrapped between the third and fourth members. In addition, the third and fourth members include axially removed channel portions which register with a portion of the axial throughbore formed between the first and second member.

A fifth member is received axially through the throughbore and perpendicularly to the first four members and includes a central reduced area portion corresponding to the cross-sectional area "B". When the fifth member is centrally positioned, it is moved laterally until its reduced area portion is received within the cross-sectional area "B" of the axial throughbore at which time portions of the fifth member overlap a portion of the third and fourth member thus locking the third and fourth member, and hence the first and second members, together.

Thereafter the sixth and final member is inserted axially through the cross-sectional area "A" of the throughbore until the sixth member is in an abutting side-by-side engagement with the fifth member and frictionally retained in position. The sixth member prevents further lateral shifting of the fifth member thus locking the puzzle together.

BRIEF DESCRIPTION OF THE DRAWING

A better understanding of the puzzle according to the present invention will be understood upon reference to the following detailed description when read in conjunction with the accompanying drawing wherein like reference characters refer to like parts throughout the several views and in which:

FIG. 1 is a perspective view showing the puzzle according to the present invention when assembled;

FIG. 2 is an exploded perspective view illustrating the initial steps of assembly of the puzzle of the present invention;

FIG. 3 is a plan view illustrating a further step in constructing the puzzle according to the present invention;

FIG. 4 is a fragmentary plan view illustrating still a further step in constructing the puzzle of the present invention;

FIG. 5 is a fragmentary cross-sectional view taken substantially along line 5—5 in FIG. 4; and FIG. 6 is an exploded perspective view, similar to FIG. 2, but illustrating the final two steps of constructing the puzzle according to the present invention.

DETAILED DESCRIPTION OF THE PRESENT INVENTION

With reference first to FIG. 1, the assembled puzzle 10 according to the present invention is thereshown and comprises a first–sixth member 12-22, respectively, each member 12-22 being elongated and substantially square in cross-sectional shape. The first and second, third and fourth, and fifth and sixth members 12-22 respectively are arranged in pairs 13, 17, and 21, respectively, so that the two members in each pair are in a side-by-side abutting relationship. Moreover, each pair 13, 17 and 21 intersect the other pairs both perpendicularly and substantially at their center or midpoint so that the puzzle 10 assumes the star-shaped configuration illustrated in FIG. 1 of the drawing when assembled. The description of the individual members 12-22 will now proceed in conjunction with the description of the assembly of the puzzle 10, it being understood, that disassembly of the puzzle 10 is obtained in the reverse direction.

With reference now to FIGS. 2 and 3, in FIG. 2 the first and second members 12 and 14 are thereshown in a side-by-side abutting engagement and with the third and fourth members 16 and 18 spaced apart from the first two members 12 and 14. Transverse channels 24 and 25 are formed on the top side of the first two members 12 and 14, respectively, so that the channels 24 and 25 register with each other when the members 12 and 14 are positioned adjacent each other. Similarly, transverse channels 26 and 27 are respectively formed on the bottom side of the members 12 and 14 which also register with each other when the members 12 and 14 are positioned together. Each transvers channel 24-27 is rectangular in cross-section and with a width corresponding to the width of one of the members 12-22.

Still referring to FIGS. 2 and 3, with the first and second members 12 and 14 positioned adjacent each other, an axial or vertical throughbore 28 is defined through this pair 13 of members. The throughbore 28 is of an irregular cross-sectional shape and comprises a first cross-sectional area "A" corresponding to the cross-sectional shape of one of the members 12-22 joined with a second and smaller cross-sectional area "B" extending outwardly from one corner of the cross-sectional area "A".

The third and fourth members 16 and 18 each have a central rectangular channel 36 and 30, respectively, formed on one side of the member and having a width equal to substantially twice the width of one of the members 12-22. The fourth member 18 is positioned laterally across the bottom of the first pair 11 of members so that the channel portion 30 registers with and is received within the registering transverse channels 26, 27 on the first two members 12 and 14. Thus positioned, the sides 32 of the channel 30 overlap the sides 34 of the first two members 12 and 14 and prevents lateral separation of the members 12 and 14.

The third member 16 similarly is positioned laterally across the top of the first pair 11 of members so that the channel 36 registers with and is received within the registering transverse channels 24, 25 on the first and second members 14. With the third and fourth members 16 and 18 thus positioned, the first and second members 12 and 14 are sandwiched and entrapped between the third and fourth members 16 and 18 while the third and fourth members 16 and 18 abut together along one side.

Still referring to FIGS. 2 and 3, both the third and fourth members 16 and 18 include vertical or axial throughbore channels 40 and 42, respectively, each of which registers with a portion of the throughbore 28 formed between the first and second members 12 and 14. The channels 40 and 42 also form a reduced area central portion 31 and 33 of the third and fourth members 16 and 18, respectively.

With reference now to FIGS. 4–6, the fifth member 20 includes a first rectangular channel 46 about its center and a second transverse rectangular channel 48 about its center and perpendicular to the channel 46. The channels 46 and 48 together form a reduced area portion 50 along one edge of the fifth member 20 which joins the two ends of the fifth member 20 together. The area of the reduced area portion 50 on the fifth member 20 corresponds substantially to the area "B" of the throughbore 28.

The fifth member 20 is insertable through the area "A" of the throughbore 28 and, when positioned midway, laterally slid to the position shown in phantom line in FIG. 4 so that the central portion 50 of the member 20 is received within the area "B" of the throughbore 28. In doing so, the channels 46 and 48 on the fifth member extend around the central portions 31 and 33 of the third and fourth members 16 and 18, respectively, which sandwiches and entraps the third and fourth members 16 and 18 and, hence the first through fourth members, together.

Thereafter, the sixth member 22 is inserted axially through the remaining open area "A" of the throughbore 28 until the sixth member 22 is in a side-by-side and abutting engagement with the fifth member 20. When thus positioned, the sixth member 22 prevents lateral movement of the fifth member 20 thereby locking the puzzle 10 together. Moreover, the sixth member 22 is dimensioned such that it is frictionally retained within the throughbore 28 and yet can be axially slid from the throughbore 28 when disassembly of the puzzle 10 is desired. Moreover, as should by now be apparent, only the sixth member 22 can move relative to the other members 12-20 once the puzzle 10 is assembled.

It can therefore be seen that the puzzle 10 according to the present invention provides a novel three-dimensional geometric puzzle which assumes a star-shaped configuration when assembled unlike the previously-known geometric puzzles. The puzzle 10 of the present invention thus overcomes the previously-known limitations of the previously-known geometric puzzles.

Having thus described my invention, many modifications thereto will become apparent to those skilled in the art to which it pertains without deviations from the spirit of the invention as defined by the scope of the appended claims.

I claim:

1. A puzzle comprising:

a first and second elongated member each having the same cross-sectional shape placed side-by-side in abutment with each other, said first and second members each having a substantially central, axial channel formed on one side so that when said first and second members are placed together in said side-by-side abutting engagement, said channels face and register with each other and together form a first throughbore of substantially said cross-sectional shape joined with a second throughbore at one corner having a second cross-sectional shape, each of said first and second members having transverse channels formed across the front and back of each member, said front and back transverse channels of the first member respectively being in registry with the front and back transverse channels of the second member and lying in a plane generally perpendicular to the axial channels;

a third and fourth elongated member, each having a transverse and axial channel formed there across, said third member being positioned laterally across the back of said first and second members so that the third member transverse channel registers with and is received within the registering back transverse channels on said first and second members, said fourth member being positioned laterally across the front of said first and second members so that the fourth member transverse channel registers with and is received within the registering front transverse channels on said first and second members, whereby said third and fourth members prevent movement of said first and second members relative to each other and relative to said third and fourth members, wherein the axial channels of said third and fourth members register with at least a portion of said first and second axial throughbores and wherein the receipt of said third and fourth member transverse channels within said first and second member transverse channels prevents movement of said third and fourth members axially and transversely along the plane of the respective third and fourth member transverse channels;

a fifth elongated member having a reduced area central portion corresponding to and received within the second throughbore having said second cross-sectional shape by transversely sliding said fifth member after its insertion into the first axial throughbore after which said first axial throughbore remains open and whereupon said fifth member abuts against and prevents movement of said third and fourth members away from each other and simultaneously prevents axial and lateral movement in the direction of the axis of said third and fourth member of said fifth member; and a sixth elongated member received and frictionally retained within said first axial throughbore thereby preventing lateral movement of said fifth member toward said axial bore and locking said puzzle together.

2. The invention as defined in claim 1 wherein each member has substantially the same rectangular cross-sectional shape.

3. The invention as defined in claim 1 wherein the third and fourth members are perpendicular with respect to the first and second member.

4. The invention as defined in claim 3 wherein the fifth and sixth members are perpendicular to the first, second, third and fourth members.

5. The invention as defined in claim 1 wherein the second cross-sectional area is smaller than the first cross-sectional area.

* * * * *

UNITED STATES PATENT AND TRADEMARK OFFICE

CERTIFICATE OF CORRECTION

PATENT NO. : 4,148,489

DATED : April 10, 1979

INVENTOR(S) : Joseph F. Pidgeon

It is certified that error appears in the above-identified patent and that said Letters Patent are hereby corrected as shown below:

Column 3, line 11, delete "transvers" and insert --transverse-- therefor;
Column 3, line 12, delete "with" and insert --has-- therefor;
Column 3, line 29, delete "11" and insert --13-- therefor;
Column 3, line 37, delete "11" and insert --13-- therefor;
Column 3, line 40, delete "14" and insert --of pair 13-- therefor;

Signed and Sealed this

*Thirty-first* Day of *July 1979*

[SEAL]

*Attest:*

*Attesting Officer*

LUTRELLE F. PARKER

*Acting Commissioner of Patents and Trademarks*